United States Patent [19]

Dixon et al.

[11] 4,404,825

[45] Sep. 20, 1983

[54] PADLOCK HAVING A REPLACEABLE CYLINDER

[75] Inventors: David Dixon, Monroe; William A. Krupicka, Charlotte, both of N.C.

[73] Assignee: Scovill Inc., Waterbury, Conn.

[21] Appl. No.: 263,036

[22] Filed: May 12, 1981

[51] Int. Cl.[3] ..... E05B 9/06

[52] U.S. Cl. ..... 70/368; 70/371

[58] Field of Search ..... 70/368, 367, 371, 38 R, 70/38 A, 38 B, 38 C, 39

[56] References Cited

U.S. PATENT DOCUMENTS

| | | | |
|---|---|---|---|
| 1,824,301 | 9/1931 | Russell | 70/38 A |
| 2,141,748 | 12/1938 | Hansen | 70/368 |
| 3,172,279 | 3/1965 | Patriquin | 70/38 A |
| 3,187,525 | 6/1965 | Dies | 70/368 |
| 3,720,083 | 3/1973 | Wellekens | 70/371 X |
| 3,835,675 | 9/1974 | Lippisch | 70/38 A |
| 3,855,824 | 12/1974 | Falk | 70/38 A |
| 3,882,699 | 5/1975 | Flack et al. | 70/38 A |
| 4,138,868 | 2/1979 | Richards | 70/367 X |

FOREIGN PATENT DOCUMENTS

| | | | |
|---|---|---|---|
| 92289 | 2/1962 | Denmark | 70/38 B |
| 554437 | 6/1932 | Fed. Rep. of Germany | 70/38 B |
| 512796 | 1/1921 | France | 70/38 B |

*Primary Examiner*—Cornelius J. Husar
*Assistant Examiner*—Lloyd A. Gall
*Attorney, Agent, or Firm*—Dallett Hoopes

[57] ABSTRACT

A stop disposed in the bottom of the shackle heel bore normally blocks movement of a pin holding the cylinder in the casing. Raising the stop when the lock is unlocked permits the pin to move away from the cylinder freeing the cylinder for replacement.

12 Claims, 3 Drawing Figures

PADLOCK HAVING A REPLACEABLE CYLINDER

BACKGROUND OF THE INVENTION

1. Field of the Invention

This invention relates to a padlock having a replaceable cylinder. More specifically, the invention relates to a padlock having a cylinder assembly and which, when the lock is open, may be removed by the use only of an elongated element such as a wire, following which a second cylinder may be inserted and retained so that the keys used before the change will be ineffective to open the padlock after the change.

2. Description of the Prior Art

The prior art is replete with examples of padlocks wherein the cylinder may be removed and changed. Examples are:

Hanson U.S. Pat. No. 2,141,748, issued Dec. 27, 1938;
Dequick U.S. Pat. No. 2,430,391, issued Nov. 4, 1947;
Dies U.S. Pat. No. 3,187,525, issued June 8, 1965; and
Lippisch U.S. Pat. No. 3,793,856, issued Feb. 26, 1974.

The prior art as a body, however, does not really teach a structure in which the cylinder may be removed and replaced with great ease and, at the same time, offer maximum security, unyieldably retaining the selected cylinder in the padlock body.

SUMMARY OF THE INVENTION

Under the present invention, the bore receiving the shackle heel extends almost to the far end of the padlock body and is parallel to the cylinder. The partition between the heel bore and the cylinder opening is formed with an aperture in line with an aperture in the cylinder and a pin normally extends in the two apertures, retaining the cylinder in the body. A slideable spool-like stop member is provided in the heel bore. This stop member is stepped and a larger step normally aligns with the pin holding it in place.

When it is desired to change the cylinder, it is merely necessary to release the shackle and insert a wire or the like through a reduced opening from below into the heel bore and push upwardly on the stop causing the smaller step to align with the pin and permitting the pin to drop out, preferably by turning the padlock on its side and letting the pin drop against the smaller step. After the new cylinder is inserted, the reverse of these steps secures it in place.

Other objects, features, and advantages of the invention will be readily apparent from the following description of a preferred embodiment thereof, taken in conjunction with the accompanying drawings, although variations and modifications may be effective without departing from the spirit and scope of the novel concepts of the disclosure.

DESCRIPTION OF THE PREFERRED EMBODIMENT

Figure 1:
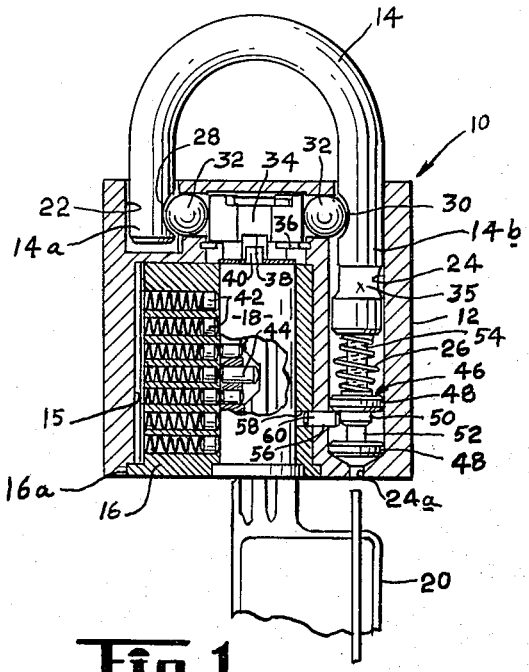
FIG. 1 is a sectional view of a padlock embodying the invention showing the shackle in closed or locked position.

In the embodiment of the invention illustrated, FIG. 1 shows a padlock generally designated 10. It includes a casing 12 having a shackle 14 generally U-shaped in form featuring the toe 14*a* and the heel 14*b*. The opposite end of the casing has a cylinder opening 15 which receives a key cylinder comprising shell 16 embracing a plug 18. The plug 18 has a slot for a key 20 opening to the bottom of the plug.

The casing 12 has parallel bores; the toe bore 22 and the heel bore 24 receiving, respectively, the toe and heel of the shackle 14. Compression spring 26 seated in the bore 24 biases the shackle upwardly out of locking engagement with the casing 12 upon the release of the lock. Both the heel and toe of the shackle have recesses 28 and 30 respectively, adapted to be engaged by locking balls 32 when the padlock is locked. The balls 32 are worked by the bolt 34 in the conventional manner. The bolt is held in place in the casing by a C-shaped ring 36. The lower end of the bolt 34 is slotted as at 38 and engaged by a tenion 40 at the upper end of the key plug 18. The heel 14*b* of the shackle is formed with an annular groove 35 which is engaged by its associated ball 32 when the lock is open. This retains the shackle and casing together. The shell contains the usual spring-biased drivers 42 which work in the conventional manner with the tumbler pins 44 and key 20 to permit the rotation of the plug to open the lock.

Figure 2:
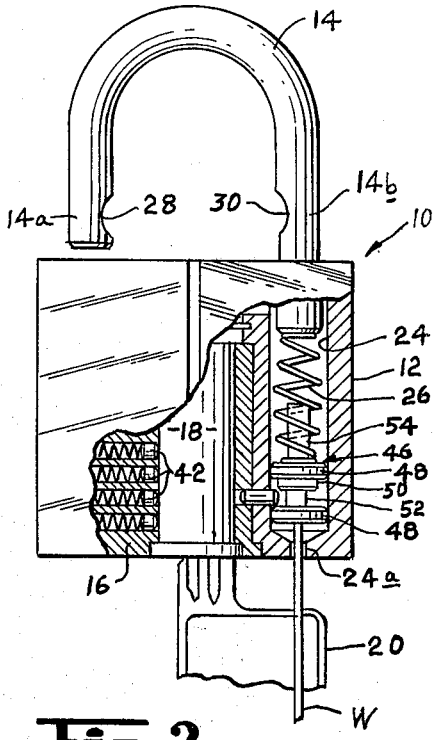
FIG. 2 is an elevational view, partly in section, showing the shackle in unlocked condition and with a wire W inserted to commence the cylinder replacement procedure.

As shown in FIGS. 1 and 2, the heel bore 24 is provided with an integral slideable stop 46, the lower portion of which may be shaped like a spool with annular guide flanges 48 and a central stepped area having a circular larger step 50 and smaller step 52. Extending upwardly from the spool-like structure is a spacer 54 which is circumposed by the spring 26. Preferably, the spacer 54, when the stop is seated on the bottom of the heel bore, reaches almost up to the heel end of the shackle 14 when the lock is locked. This precludes the upward movement of the stop should an attempt be made by an unauthorized person to move it upwardly.

The metal of the casing between the heel bore 24 and a cylinder opening 15 is apertured as at 56 in line with an aperture 58 in the cylinder shell 16. In these aligned apertures is disposed a pin 60 which holds the cylinder firmly within the padlock casing. In its normal condition, the pin is held in place by butting against the larger step 50 of the stop 46.

Figure 3:
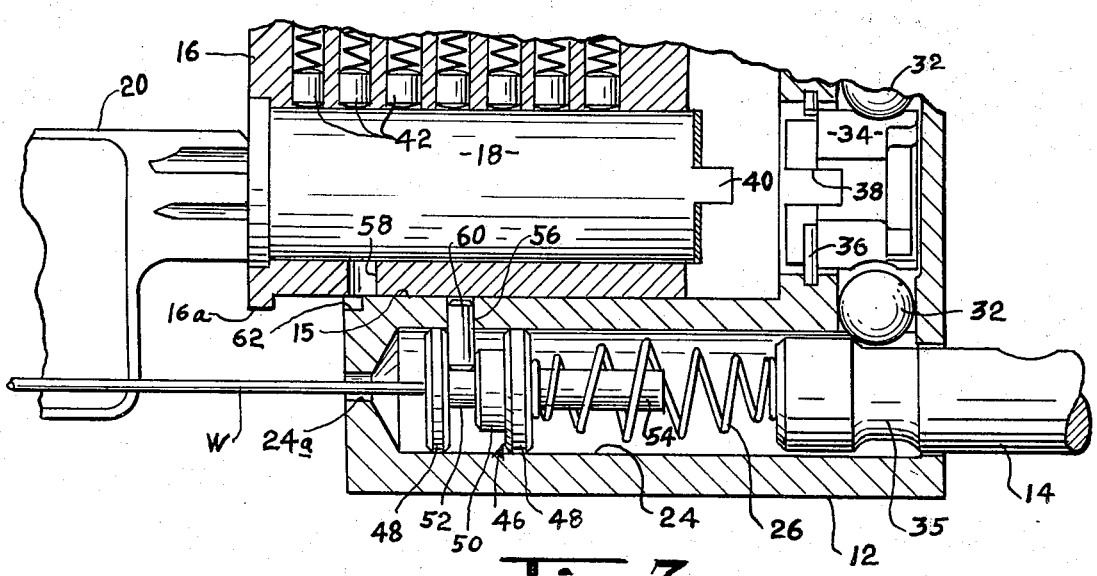
FIG. 3 is a greatly enlarged fragmentary sectional view of the padlock taken from FIG. 2 and turned 90° in a clockwise direction and showing how the locking pin may be manipulated and the cylinder withdrawn.

Referring now to FIG. 2, it will be noted that the lock is shown in unlocked condition. The spacer 54 is thereby afforded clearance beneath the shackle heel 14*b* to permit the stop 46 to be raised by a wire or similar tool W inserted through the stop access hole 24*a*. The upward movement of the stop 46 is accomplished against the bias of the spring 26. As shown, the space is raised so that the lesser step 52 aligns with the pin 60. Because the pin 60 normally protrudes into the space between the two guide flanges 48, the travel of the stop 46 is limited as the pin hits the respective flanges. In FIG. 2, with the lesser step 52 lined up with the pin 60, the lock is now in condition for removal of the cylinder and this is accomplished as shown in FIG. 3 by turning the lock on its side so that gravity causes the pin 60 to fall against the lesser step 52. At this point, the pin 60 is completely out of hole 58 so that the lock cylinder may be removed leftwardly as shown in FIG. 3.

With the key 20, the cylinder 16 and plug 18 may be removed and replaced by a new cylinder and plug having a different key.

In securing the new cylinder in place, it is merely necessary to push the new cylinder into the opening 15 to a point where its flange 16*a* nests in the recess 62 about the cylinder opening 15. Holding the wire W in the position shown in FIG. 3, the padlock is then inverted (not shown) so that the pin 60 may drop down into the aligned aperture 58 to secure the cylinder in position. Thereafter, the wire W is withdrawn and the spring 26 urges the stop 46 to seat at the bottom of the heel bore 24.

It may be seen from the foregoing that a simple release for the key cylinder of a padlock has been provided, accommodating quick removal of the key cylinder to be replaced by a key cylinder having a different tumbler combination by merely unlocking the padlock, poking up through the access 24*a* with a wire W or the like to shift the position of the stop 46 and thereby permit the pin 60 to drop and then withdrawing the key cylinder for replacement with another key cylinder of a different tumbler combination.

We claim:

1. A changeable-cylinder padlock comprising a body having a large central opening formed in one end thereof, a cylinder disposed in the opening, the other end of the body being formed with a pair of spaced bores, a shackle, one of said bores receiving the heel and the other the toe of the shackle, the heel-receiving bore being parallel to and spaced from the cylinder opening, bolt means inside the housing associated with the cylinder selectively to hold the shackle in locked position, the heel bore extending well beyond the heel end of the shackle and being reduced at a shoulder to an access hole extending to the said one end of the body, the body being formed with a passage between the heel bore and the cylinder opening, pin means being reciprocably disposed in said passage and normally extending into an aperture in the cylinder thereby holding the cylinder in the body, spool-like stop means disposed in the heel bore and normally blocking the pin means for moving away from the cylinder, the height of the stop means in the heel bore when the lock is locked and the shackle down keeping the stop means in blocking position, but the stop being movable when the lock is open to permit the pin means to vacate said aperture in the cylinder and permit withdrawal of the cylinder.

2. A changeable-cylinder padlock as claimed in claim 1 wherein the stop can be moved to unblocking position by extending a thin elongate element through the access hole.

3. A changeable-cylinder padlock as claimed in claim 1 wherein the stop element is spring-biased in the blocking position by a shackle bearing against the end of the shackle heel.

4. A cylinder padlock as claimed in claim 1 wherein the stop means comprises a spool-like element being stepped and having two diameters, one of which when aligned with the pin means holds said pin means in said aperture in the cylinder, and the other of which when aligned with the pin means, permits the pin to slide away from the cylinder and permitting the cylinder to be removed.

5. A cylinder padlock as claimed in claim 1 wherein when the lock is shut the stop means extends between the heel end of the shackle and the shoulder.

6. A padlocking having a removable cylinder comprising a conventional housing and shackle and cylinder in the end of the housing, the heel of the shackle being disposed in a bore which also contains beneath the heel a stepped spool-like stop means having a wider and narrower step and pin means extending through a hole in the (body) housing and normally into an aperture in the cylinder and is held therein by the abutment of the opposite end of the pin with the wider of the steps, the body being formed with an access (hole) opening under the said shackle heel; whereby a tool may be inserted into said access (hole) opening to move the stop means to a position at which the narrower step aligns with the pin means to permit the pin to move and leave the aperture in the cylinder whereby the cylinder may be removed.

7. A padlock as claimed in claim 6 wherein the stop is spring-biased away from the heel.

8. A padlock as claimed in claim 6 wherein the stop has, on the opposite sides of the stepped surfaces respectively, a pair of guide discs.

9. A padlock as claimed in claim 6 wherein the length of the stop is approximately equal to the distance between the bottom of the heel and the bottom of the (hole) bore when the shackle is in a locked disposition.

10. A padlock as claimed in claim 6 wherein the pin is longer than the combined length of said hole in the housing and the depth of the aperture in the cylinder, whereby the portion of the pin extending into the heel bore disposed between the guide discs serves as a limit for the travel of the stop.

11. A padlock having a removable cylinder comprising a conventional housing and shackle and a cylinder in the end of the housing, the heel of the shackle being disposed in a bore which also contains beneath the heel a stop means and pin means extending through a hole in the housing from the heel bore to the cylinder and normally into an aperture in the cylinder and is held therein by the blocking of the opposite end of the pin by the stop means, the housing being formed with an access hole under the said shackle heel, whereby a tool may be inserted into said access hole to move the stop means to a position at which the stop is shifted and permits the pin means to move and leave the aperture in the cylinder whereby the cylinder may be removed.

12. A padlock as claimed in claim 11 wherein a spring between the stop means and the heel biases the stop means in blocking position.

* * * * *